United States Patent [19]

Mahoney et al.

[11] 4,358,324

[45] Nov. 9, 1982

[54] METHOD OF IMPARTING A FINE GRAIN STRUCTURE TO ALUMINUM ALLOYS HAVING PRECIPITATING CONSTITUENTS

[75] Inventors: Murray W. Mahoney, Camarillo; C. Howard Hamilton; Neil E. Paton, both of Thousand Oaks, all of Calif.

[73] Assignee: Rockwell International Corporation, El Segundo, Calif.

[21] Appl. No.: 236,364

[22] Filed: Feb. 20, 1981

[51] Int. Cl.[3] ..... C22F 1/04

[52] U.S. Cl. ..... 148/12.7 A

[58] Field of Search ..... 148/12.7 A

[56] References Cited

U.S. PATENT DOCUMENTS 4,092,181 5/1978 Paton et al. ..... 148/12.7 A

*Primary Examiner*—R. Dean

*Attorney, Agent, or Firm*—H. Fredrick Hamann; Craig O. Malin

[57] ABSTRACT

A method is provided to impart a fine grain structure to aluminum alloys which have precipitating constituents. The alloy is overaged to form coarse precipitates, and then plastically deformed at least 40%. Deformation is accomplished at a temperature and at a rate which are sufficient to retain strain energy in the alloy at the end of the deformation step. The alloy is subsequently heated at a rate of at least 0.02° F.·s$^{-1}$ to a recrystallization temperature to form a new fine grain structure.

5 Claims, 1 Drawing Figure

METHOD OF IMPARTING A FINE GRAIN STRUCTURE TO ALUMINUM ALLOYS HAVING PRECIPITATING CONSTITUENTS

BACKGROUND OF THE INVENTION

1. Field of the Invention

This invention relates to the field of metallurgy, and particularly to the field of processing precipitation hardening aluminum alloys.

2. Description of the Prior Art

A fine grain size tends to improve the mechanical properties of many structural materials. Additionally, formability can be improved by elimination of "orange peel" structure, and superplasticity realized in many alloys by providing a fine grain structure. In some environments, some alloys have better corrosion resistance when their structure is fine grain rather than coarse grain. However, grain refinement is difficult to achieve in aluminum alloys, and most attempts to obtain a fine grain size by conventional mechanical working and recrystallization by heating have only resulted in the material recrystallizing to the original coarse grain size with large "pancake" shaped grains.

U.S. Pat. No. 4,092,181 to Paton and Hamilton describes a method of imparting a fine grain to precipitation hardening aluminum alloys. U.S. Pat. No. 4,222,797 to Hamilton, Mahoney, and Paton describes an improvement in the earlier method which utilizes an increased rate of forming to obtain finer grains. According to both these prior methods, an aluminum alloy is overaged to develop grain refining precipitates, mechanically worked to provide strain energy, and then heated to above its recrystallization temperature to recrystallize into a fine grain structure. The present invention utilizes these same process steps, but includes additional features which minimize the resultant grain size.

SUMMARY OF THE INVENTION

It is an object of the invention to provide an improvement in a method for refining the grain size of aluminum alloys containing precipitation hardening constituents.

It is an object of the invention to provide precipitation hardenable aluminum alloys which have a fine grain size.

According to the invention, a method is provided for imparting a fine grain structure to aluminum alloys which have precipitating constituents. The alloy is first heated to a solution treating temperature to dissolve the precipitating constituents in the alloy. The alloy is then cooled, preferably by water quenching, to below the solution temperature and then overaged to form a uniform distribution of small precipitates by heating it above the precipitation hardening temperature for the alloy but below its solution treating temperature. Strain energy is then introduced into the alloy by plastically deforming it. The alloy is subsequently heated at a rate of at least 0.02 $F.\cdot s^{-1}$ to above its minimum recrystallization temperature so that new grains are nucleated by the overaged precipitates and the growth of these grains provides a fine grain structure.

In a preferred embodiment, the alloy is heated to the recrystallization temperature while it is still hot from the plastic deforming step.

These and other objects and features of the present invention will be apparent from the following detailed description.

DESCRIPTION OF THE PREFERRED EMBODIMENT

Figure 1:
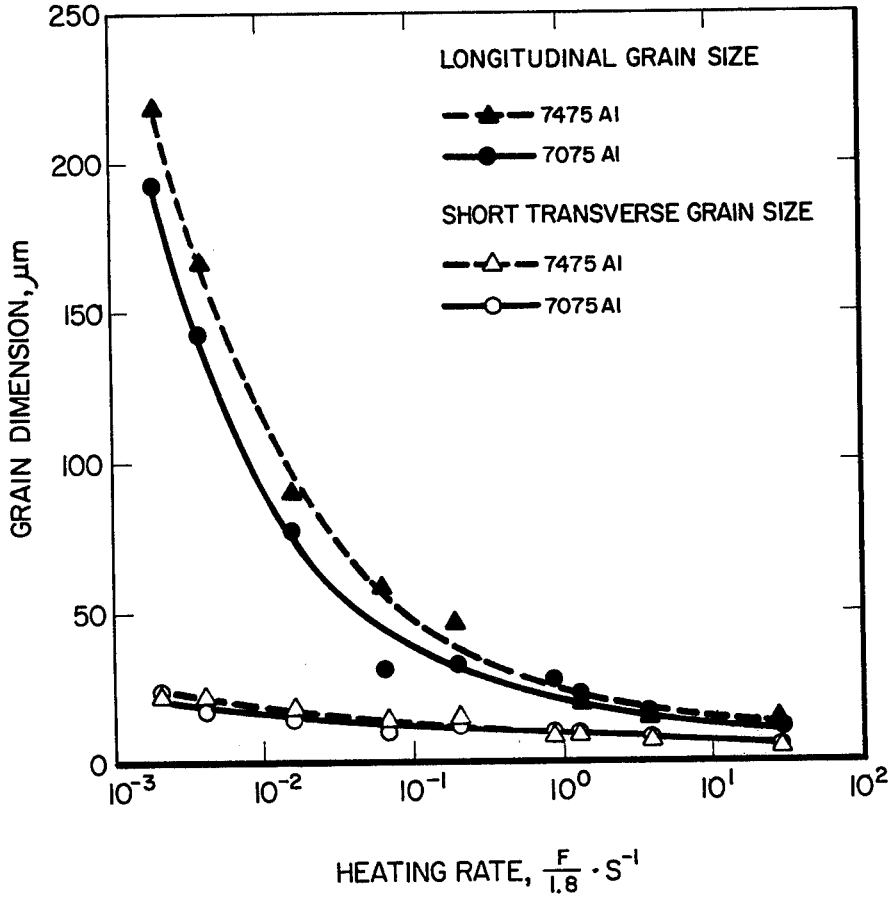
FIG. 1 is a graph showing the relationship between grain size and the rate of heating to the recrystallization temperature for type 7475 and type 7075 aluminum alloys.

According to an embodiment of the invention, the alloy is first solution treated in the conventional way, as would be done prior to precipitation hardening. In this condition the structure of the alloy is coarse-grained and the precipitating constituents are in solid solution. Instead of being followed by the standard precipitation hardening treatment (a low temperature aging treatment to produce a fine distribution of precipitates spaced 100 to 500 A apart suitable for increasing the strength of the alloy), the material is subjected to a high temperature precipitation treatment, called overaging, which produces a somewhat coarser distribution of precipitates spaced ~5,000 to 10,000 A apart, as described in U.S. Pat. No. 4,092,181.

Next, the material is mechanically worked (plastically deformed) to provide the lattice strain energy which is necessary for recrystallization. The plastic deformation can be accomplished at elevated temperatures in order to take advantage of the alloy's improved formability at elevated temperatures. However, the material must be deformed at a sufficiently high rate so that strain energy is created in the material faster than it is removed by recovery and recrystallization. At forming temperatures near (either below or above) the recrystallization temperature, the rates of reduction achieved by laboratory and production rolling mills are sufficiently high provided that a large reduction in area is accomplished during a single pass through the rolls. At lower temperatures (e.g., room temperatures to 450 F.) the deformation rate can be much slower because recovery of the material is negligible or much slower. As known in the industry, plastic deformation can be accomplished by rolling, by extrusion, by drawing, and by forging to produce various products such as plate, bar, sheet, wire, forgings, etc.

Finally, the worked material is recrystallized by heating it above its minimum recrystallization temperature but below its solidus temperature at which time new grains are nucleated at or around the precipitates formed during the previous overaging treatment. It also appears that these precipitates act to retard further grain growth.

To accomplish recrystallization, material which has been hot worked can be heated directly to its recrystallization temperature, or it can be cooled to a lower temperature such as room temperature and later heated to its recrystallization temperature. In either case, the worked material should be heated rapidly to its recrystallization temperature. A heating rate of at least 0.02° F. per second (0.02 $F.\cdot s^{-1}$) is necessary to obtain grains shorter than about 100 $\mu$m. However, faster heating rates are preferred because they result in finer grains as is evident from the following examples. In these examples, samples of type 7475 and type 7075 aluminum alloy were processed to determine the reduction in grain size which could be obtained using various heating rates to the recrystallization temperature. In all examples, the starting material had large pancake shaped grains averaging about 30 μm thick (the short transverse direction) and 300 μm in diameter (the longitudinal direction).

EXAMPLE 1

Aluminum Alloy 7475

Samples of 7475 aluminum alloy were solution treated in the standard range of 860° F. to 930° F. (actually 900° F. for these samples) for 3 hours and water quenched to maintain the precipitate in solution. The samples were then overaged at 750° F. for about 8 hours. This treatment produced a distribution of relatively coarse precipitates suitable for obtaining a fine grain structure during a subsequent recrystallization treatment.

The overaged samples were then plastically deformed 90% at 392 F. and cooled to room temperature by water quenching. The samples were then heated to a recrystallization temperature of 900° F. at heating rates ranging from about 0.002° F. per second to 90° F. per second, held at that temperature for 5 minutes to recrystallize them, and then water quenched. The resulting grain sizes were measured in both the longitudinal and transverse directions. As shown by the dashed curves in FIG. 1, the more rapid the rate of heating to the recrystallization temperature, the smaller the grain size, particularly in the longitudinal direction.

EXAMPLE 2

Aluminum Alloy 7075

Samples of 7075 aluminum alloy were solution treated, overaged, plastically deformed, and recrystallized as described above for Example 1. The resulting grain sizes are shown by the solid curves in FIG. 1. The results are similar to the results obtained for 7475 alloy in that rapid heating promoted a fine grain structure.

From the above examples, one skilled in the art can readily develop appropriate heat treatment and plastic deformation schedules for any precipitation hardening aluminum alloy based upon standard solution treating and precipitation hardening treatments. Table I below, abstracted from "Metals Handbook", vol. 2, 8th edition, p, 272, American Society for Metals, gives these standard treatments for many aluminum alloys, except for alloys 7049 and 7050 for which estimated values are given.

Material which has been previously solution treated by the supplier can be directly overaged without repeating the solution treatment. Also, material which has been solution treated and then given a precipitation hardening treatment can be directly overaged without requiring an additional solution treatment to redissolve the fine distribution of precipitates.

The term precipitation hardening refers to precipitates developed at times and temperatures (such as shown in Table I) which give the alloy optimum strength properties. The term overaging refers to precipitates developed at longer times and/or higher temperatures than used for precipitation hardening.

TABLE I

STANDARD HEAT TREATMENT RANGES OF WROUGHT ALUMINUM ALLOYS

| | Solution | Precipitation Hardening Treatment | |
|---|---|---|---|
| Alloy | Temperature (F.) | Time (hr) | Temperature (F.) |
| 2014 | 925 to 945 | 9 to 19 | 310 to 350 |

TABLE I-continued

STANDARD HEAT TREATMENT RANGES OF WROUGHT ALUMINUM ALLOYS

| | Solution | Precipitation Hardening Treatment | |
|---|---|---|---|
| Alloy | Temperature (F.) | Time (hr) | Temperature (F.) |
| 2018 | 940 to 960 | 5 to 11 | 330 to 460 |
| 2020 | 950 to 970 | 17 to 19 | 310 to 330 |
| 2024 | 910 to 930 | 17 to 18 | 370 to 380 |
| 2218 | 940 to 960 | 5 to 11 | 330 to 460 |
| 2219 | 985 to 1005 | 9 to 19 | 340 to 385 |
| 2618 | 970 to 990 | 19 to 21 | 385 to 395 |
| 4032 | 940 to 970 | 9 to 11 | 330 to 350 |
| 6053 | 960 to 985 | 7 to 19 | 310 to 360 |
| 6061 | 970 to 1000 | 7 to 19 | 310 to 360 |
| 6062 | 970 to 1000 | 7 to 19 | 310 to 360 |
| 6063 | 970 to 1000 | 7 to 19 | 310 to 360 |
| 6066 | 970 to 1000 | 7 to 19 | 310 to 360 |
| 6151 | 960 to 980 | 9 to 19 | 310 to 350 |
| 7049 | 860 to 930 | 23 to 28 | 240 to 260 |
| 7050 | 860 to 930 | 23 to 28 | 240 to 260 |
| 7075 | 860 to 930 | 23 to 28 | 240 to 260 |
| 7076 | 860 ot 880 | 13 to 15 | 270 to 280 |
| 7079 | 820 to 880 | 5 days + | room temperature |
| | | 48-50 hrs. | 230 to 250 |
| | | or 6-10 days + | 190 to 200 |
| | | 23-28 hrs. | 240 to 260 |
| 7178 | 860 to 880 | 23 to 28 | 240 to 260 |

The relation between time and temperature for age hardening aluminum alloys is also well known in the art. For example, low aging temperatures require longer hold times to accomplish equivalent amounts of aging as can be accomplished at high aging temperatures for shorter hold times. Likewise, the hold time for solution treatment is a function of the hold temperature, although within a narrower temperature range.

The solvus temperature is the temperature at which the precipitating elements in the alloy begin to dissolve into the solid, or approximately the minimum solution temperature shown in Table I. For the purpose of this invention, 900° F. is below the solvus temperature for all the 2000 series alloys. For the 6000 series alloys, 940° F. is below the solvus temperature, and for the 7000 series, 800° F. is below the solvus temperature.

It is also known to the artisan that the recrystallization temperature is related to the amount of plastic strain (mechanical work or cold work) introduced into the lattice. For severely worked aluminum alloys, the minimum recrystallization temperature is over 600° F. Likewise, the amount of mechanical work of the alloy required to permit recrystallization varies depending upon factors such as the recrystallization temperature and the time at the recrystallization temperature. For practicing this invention, the amount of mechanical work, as measured by reduction in cross-sectional area, should be over 40%.

This invention can be incorporated into standard metal forming operations such as rolling, forging, drawing, and extruding by modifying the schedule to conform to the requirements of the invention. For example, in rolling mills for fabricating plate, sheet, and bar, the stock can be overaged to provide a coarse precipitate, and then rolled at the proper temperature and percent reduction to provide the deformation necessary to obtain a fine grain. In forging operations, the forging blanks can be preformed as may be necessary, overaged to provide the coarse precipitate, and then plastically deformed during the forging operation.

After the material has been plastically deformed, it can be either cooled to a lower temperature prior to recrystallization or heated immediately to the recrystallization temperature while it is still hot. However, for large sections which are slow to heat, the material should not be cooled, but should be heated directly to the recrystallization temperature so as to avoid a slow reheating operation. Heating rates in the interior areas of thick sections may be increased with the aid of low frequency induction heating methods.

Numerous variations and modifications may be made without departing from the present invention. Accordingly, it should be clearly understood that the form of the present invention described above is illustrative only and is not intended to limit the scope of the present invention.

What is claimed is:

1. An improvement in a method of imparting a fine grain structure to an aluminum alloy having a precipitating constituent, said method having steps of:

providing an aluminum alloy having a precipitating constituent;

dissolving at least some of said precipitating constituent in said alloy by heating said alloy to a solid solution temperature;

cooling said alloy to a temperature below said solid solution temperature;

overaging said alloy to form precipitates;

plastically straining said alloy; and recrystallizing said alloy;

said improvement being characterized in that said step of recrystallizing said alloy comprises:

heating said alloy at a rate of at least 0.02 $F.\cdot s^{-1}$ to a temperature above its minimum recrystallization temperature, whereby said precipitates form nuclei for the recrystallization and controlled growth of a fine grain structure.

2. A method of imparting a fine grain structure to an aluminum alloy selected from the group consisting of aluminum alloy numbers 7049, 7050, 7075, 7475, 7076, 7079, and 7178, comprising:

providing an aluminum alloy from said group;

heating said alloy to a solution temperature in the range of 820° F. to 930° F. to dissolve precipitating constituents in said alloy;

cooling said alloy to a temperature below said solution temperarture;

heating said alloy to an overaging temperature in the range of approximately 280° F. to 820° F. to overage said alloy;

plastically deforming said alloy by reducing its cross-sectional area a minimum of 40% at a temperature and at a rate which are sufficient to retain strain energy in said alloy at the end of the deformation step; and heating said alloy at a rate of at least 0.02 $F.\cdot s^{-1}$ to a temperature in the range of approximately 750° F. to 930° F., whereby said alloy recrystallizes into a fine grain structure.

3. A method of imparting a fine grain structure to an aluminum alloy selected from the group consisting of 7475 and 7075, comprising:

providing an alloy from said group;

heating said alloy to a solution temperature in the range of 860° F. to 930° F. to dissolve precipitating constituents in said alloy;

cooling said alloy to a temperature below said solution temperature;

heating said alloy at an overaging temperature of about 750° F. for about 8 hours;

plastically deforming said alloy by reducing its cross-sectional area about 90% at a temperature of about 390° F., the deformation occurring at a sufficient rate to retain strain energy at the end of the deformation step; and heating said alloy at a rate of at least 0.02 $F.\cdot s^{-1}$ to a temperature of approximately 900° F., whereby said alloy recrystallizes into a fine grain structure.

4. A method of imparting a fine grain structure to an aluminum alloy selected from the group consisting of aluminum alloy numbers 2219, 6053, 6061, 6062, 6063, 6066, and 6151, comprising:

providing an aluminum alloy from said group;

heating said alloy to a solution temperature in the range of approximately 960° F. to 1005° F. to dissolve precipitating constituents in said alloy;

cooling said alloy to a temperature below said solution temperature;

heating said alloy to an overaging temperature;

plastically deforming said alloy by reducing its cross-sectional area a minimum of 40% at a temperature and at a rate which are sufficient rate to retain strain energy in said alloy at the end of the deformation step; and heating said alloy at a rate of at least 0.02 $F.\cdot s^{-1}$ to a temperature in the range of approximately 705° F. to 1005° F., whereby said alloy recrystallizes into a fine grain structure.

5. A method of imparting a fine grain structure to an aluminum alloy selected from the group consisting of aluminum alloy numbers 2014, 2018, 2020, 2024, and 4032, comprising:

providing an aluminum alloy from said group;

heating said alloy to a solution temperature in the range of approximately 910° F. to 960° F. to dissolve precipitating constituents in said alloy;

cooling said alloy to a temperature below said solution temperature;

heating said alloy to an overaging temperature in the range of approximately 330° F. to 910° F. to overage said alloy;

plastically deforming said alloy by reducing its cross-sectional area a minimum of 40% at a temperature and at a rate which are sufficient to retain strain energy in said alloy at the end of the deformation step; and heating said alloy at a rate of at least 0.02 $F.\cdot s^{-1}$ to a temperature in the range of approximately 705° F. to 960° F., whereby said alloy recrystallizes into a fine grain structure.

* * * * *